United States Patent [19]

Lenzi

[11] Patent Number: 4,576,673

[45] Date of Patent: Mar. 18, 1986

[54] SERVICE UNIT INTENDED TO CONTINUOUSLY SUPPLY A HIGH-SPEED PRINTER WITH PREFORMED SUPPORT PACKAGES

[76] Inventor: Mauro Lenzi, Via G. Paganino, 2, 56100 Pisa, Italy

[21] Appl. No.: 632,587

[22] Filed: Jul. 19, 1984

[51] Int. Cl.[4] ..... B31F 5/00

[52] U.S. Cl. ..... 156/350; 156/502

[58] Field of Search ..... 156/505, 157, 350, 351

[56] References Cited

U.S. PATENT DOCUMENTS

| | | | |
|---|---|---|---|
| 3,776,795 | 12/1973 | Stevenson | 156/505 X |
| 3,957,567 | 5/1976 | Dursell et al. | 156/505 |
| 4,056,426 | 11/1977 | Sipin | 156/505 |
| 4,239,582 | 12/1980 | McGrath | 156/505 |
| 4,252,597 | 2/1981 | Monroe | 156/505 |

*Primary Examiner*—David Simmons

*Attorney, Agent, or Firm*—Brooks Haidt Haffner & Delahunty

[57] ABSTRACT

A service unit intended to continuously supply a high-speed printer using a preformed support comprising folded paper packages, comprising in combination: a backing plane for the support packages placed side by side, comprising a conveyor belt controlled by a microprocessor which using a sensor automatically puts in position each package to be supplied to the printer; a plane for joining the paper support between two adjacent packages, which plane can move with respect to the package backing plane in order to allow all the packages arranged for being supplied to the printer to be continuously connected to each other, this joining plane being provided with retractile reference pins for placing and blocking the paper in position, a support for the adhesive tape having suitable drives and guides, an assembly for cutting the adhesive tape after the joining operation, a microprocessor controlling the cutting operation, the movement of the packages and discriminating the packages according to the size thereof or the single sheets on the filling call and coordinating all the various steps.

8 Claims, 16 Drawing Figures

SERVICE UNIT INTENDED TO CONTINUOUSLY SUPPLY A HIGH-SPEED PRINTER WITH PREFORMED SUPPORT PACKAGES

As known, in electronic data processing centers high-speed printers, of which the latest type in the art is known as laser printer, are so fast as to make a discontinuous supply and collection of the processed paper web in separate packages uneconomic, as it is the case with the devices with which such high-speed printers were provided heretofore, since this requires a great number of successive work stops. These work stops occur on the supply of a new package and the connection thereof to the preceding package and on the collection of the package of processed paper, when the forms are cut and the paper web is folded for forming the successive package.

In this connection, it should be noted that the the actual average operational speed of a high-speed printer as it is supplied by the manufacturer is about 50% of the printing speed thereof.

As a result of the foregoing, a number of service units have been recently devised intended to be used in connection with high-speed printers. These service units are auxiliary assemblies intended to allow a continuous supply to the printing units and collection therefrom, thus allowing the high processing speed of these equipments to be fully used. With regard to the service units supplying high-speed printers, two different concepts have been considered, and more precisely:

units intended to supply high-speed printers from a roll of a preformed paper web; and, units intended to continuously supply high-speed printers from packages of a preformed paper web.

Both the units of the above-mentioned types allow a continuous supply to high-speed printers to take place, but they have extremely different features which in terms of advantages and drawbacks can be summarized as follows:

the supply to high-speed printers from a paper web roll has the advantage of a long autonomy of supply to the printer after the insertion of the paper roll in the device, while the drawbacks are an impractical transport of the paper to be processed, a difficult storing, the need of a powerful means for the transport, a remarkable waste of the support in case of bumps or damage to the roll, the impracticality of carrying out small productions, which require different supports, and long dead times for replacing the roll;

the supply to high-speed printers from paper support packages has all the inherent advantages of the possibility of handling packages of a small size and the drawbacks related to the realization of the devices which are either extremely simple or extremely complex, but all require the action of an operator at the end of each package used by the printer.

It is believed that in the practice the most effective method for transporting, holding and handling the paper to be processed by the printers is using a number of packages of pre-perforated sheets, that is a continuous paper web wherein the single "sheets" or "pages" are defined by a succession of weakening lines transversal to the web and intended to facilitate the possible tear separation of the sheets. The web is also provided on both sides with a succession of equally spaced standard holes called "transport holes" which are used for moving and positioning the paper web in a known manner both in printers and in apparatus of other types.

Accordingly, a unit has been studied and realized intended to continuously supply high-speed printers and having all the advantages of the two types of service units mentioned above. These advantages are as follows:

(1) continuous supply to high-speed printers from paper support packages;

(2) possibility of supplying the high-speed printer as long as in the case of a paper roll supply, but without requiring the action of the operator;

(3) "call" of the service unit to the operator for "refilling";

(4) simple realization;

(5) easy use; and, (6) reliability of the system, resulting from the previous two advantages.

The novelty of the invention is the base of the operation thereof which in its apparent simpleness involves both an extreme rationalization of the functions and the application of completely original solutions, such as the cutting of the adhesive tape joining two adjacent packages which is carried out without using a counterblade.

The invention is also new in that it allows a plurality of adjacent packages placed side by side to be continuously joined for the supply to the printer, thus assuring the same supply as with a paper roll, but without requiring an operator and with the advantages offered by the handling of packages.

The invention is also provided with a device which maintains the package being supplied to the high-speed printer in the optimal position, by moving the whole series of packages as they are used, and also calls the operator for refilling during the time required for the consumption of the last package. The operator, of course, each time stores the number of the packages forming the series he has composed in the unit memory.

The invention is also original in that the pins for placing the paper in position on the joining plane are completely retractile, thus allowing three different aims to be reached and accordingly: using very precise reference pins in the paper transport holes for the positioning of the paper and the successive joining operation; completely releasing the paper web from the pins after the joining operation; and, making the joining plane completely free from any projections which could "hook" the paper coming out from below the joined paper web.

The frictional effect required for maintaining the right tension of the adhesive tape, both during the stretching thereof and the joining operation should also be noted. This frictional effect is obtained through the drag exerted by the adhesive tape which is moved on the rotating guiding cylinder with the adhesive side thereof facing the cylinder. The rotating cylinder placed at the opposite end of the joining plane with respect to the adhesive tape roll and at the center of the web positioning wedge has a similar function when a small return movement of the adhesive tape is required during the joining step.

The service unit of the invention will be now described in detail with reference to the annexed drawings, wherein.

Figure 4B:
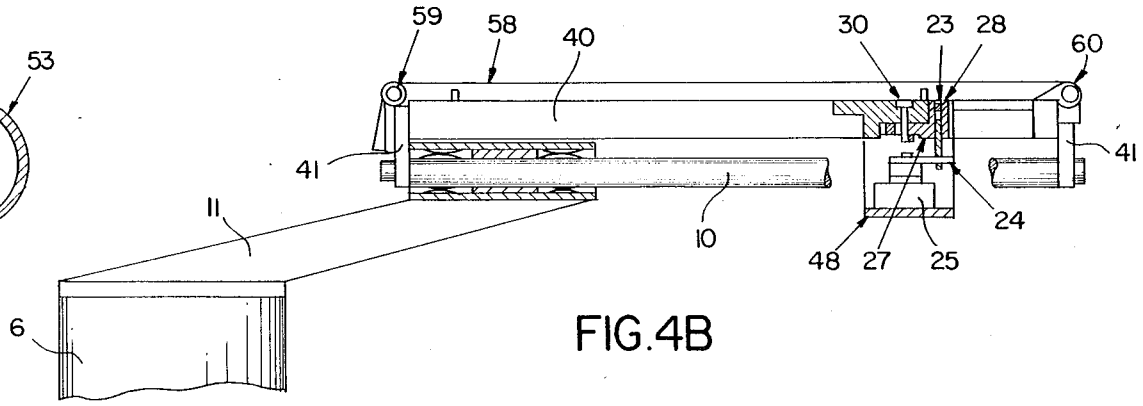
Figure 4:
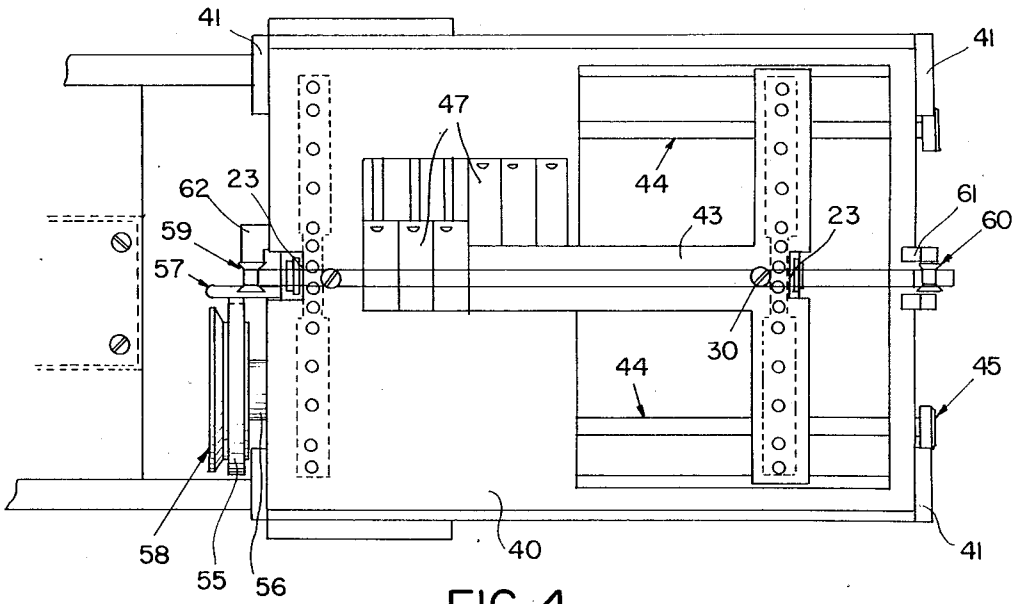
Figure 4A:
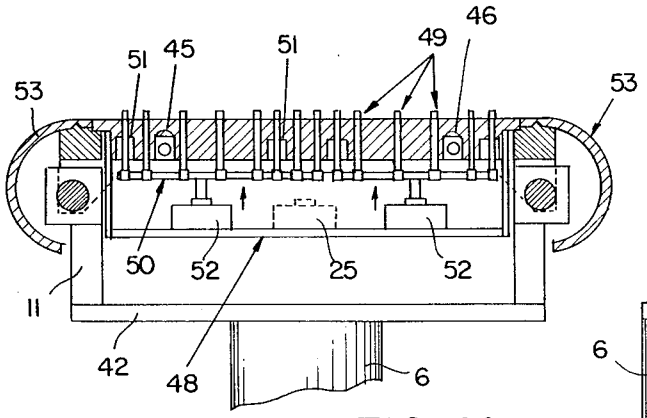
Figure 4C:
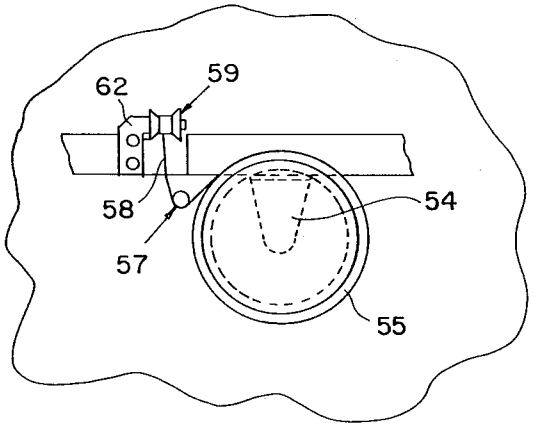
Figure 5A:
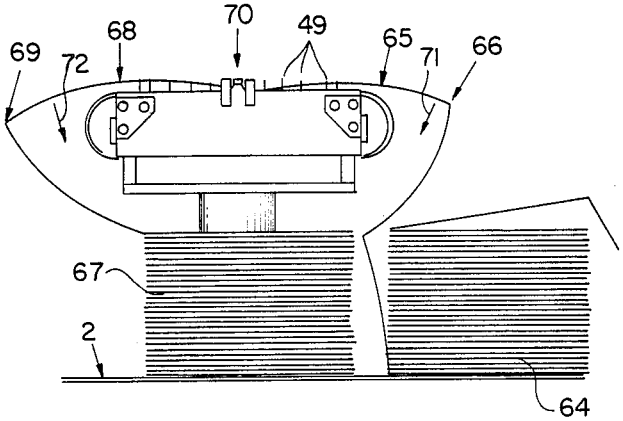
Figure 5B:
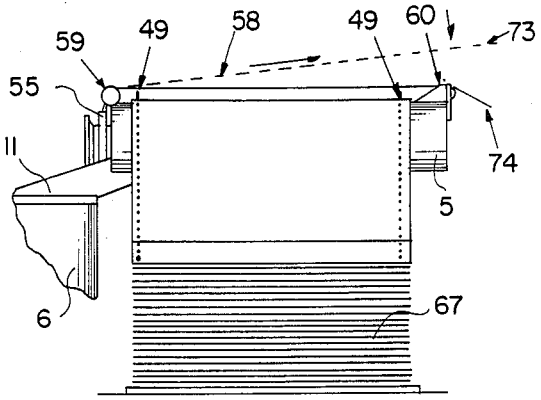
Figure 5C:
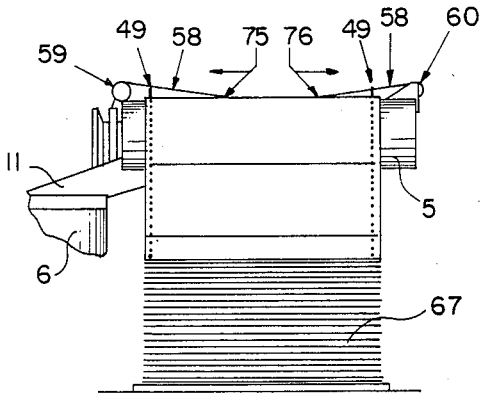
Figure 5D:
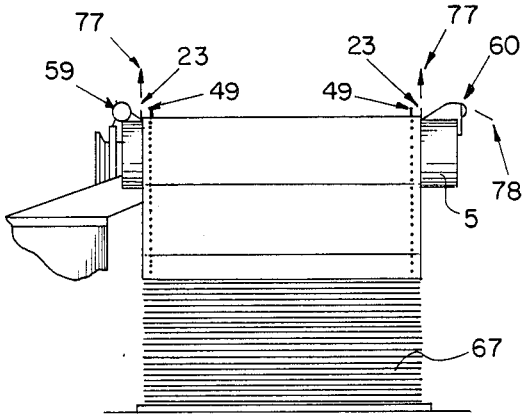
Figure 5E:
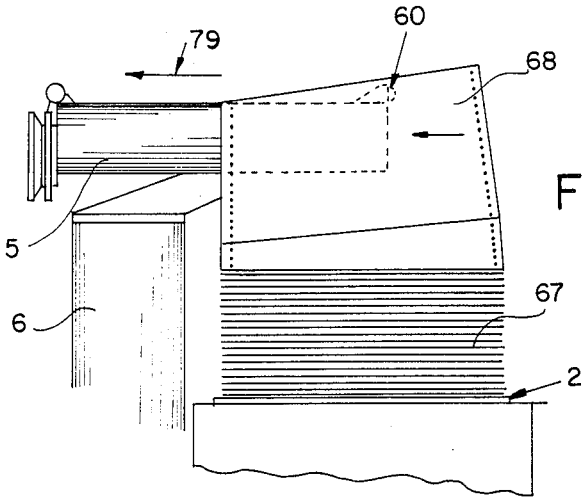
Figure 6A:
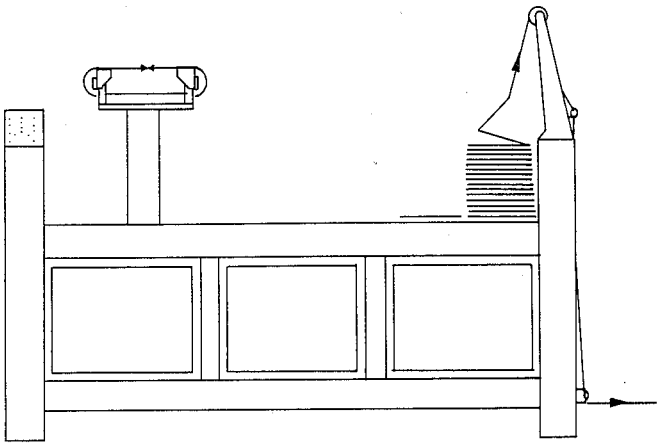
Figure 6B:
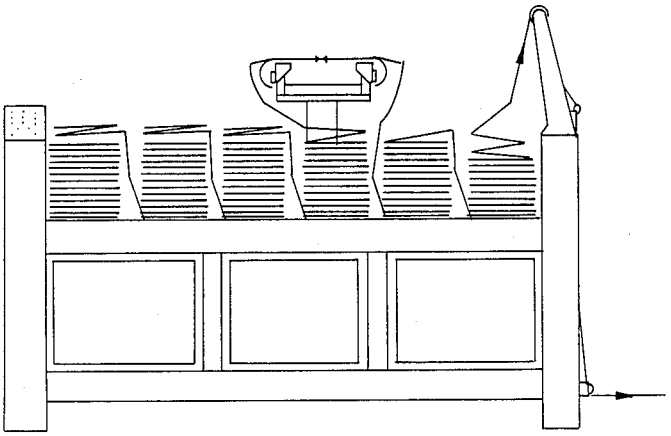
Figure 6C:
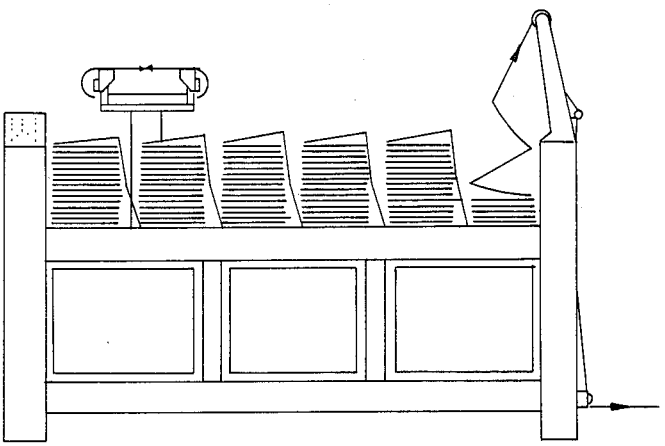

FIGS. 4–4*c* are essential views of the joining plane showing the retractile paper positioning and blocking pins and the transport means therefor; an assembly for adjusting the transversal size of the paper with a filling system acting by contrast during the joining operation; a system for placing the adhesive tape in position, having suitable guides and drives; cutting blades and the operating means therefor; and, a sliding system for clearing the working area and secured to the central supporting rod of the plane;

FIGS. 5A–5E show the steps of a typical joining operation of two adjacent packages of a preformed pacer support; and, FIGS. 6A–6C show a typical filling cycle of the service unit during the normal operation thereof.

Figure 1:
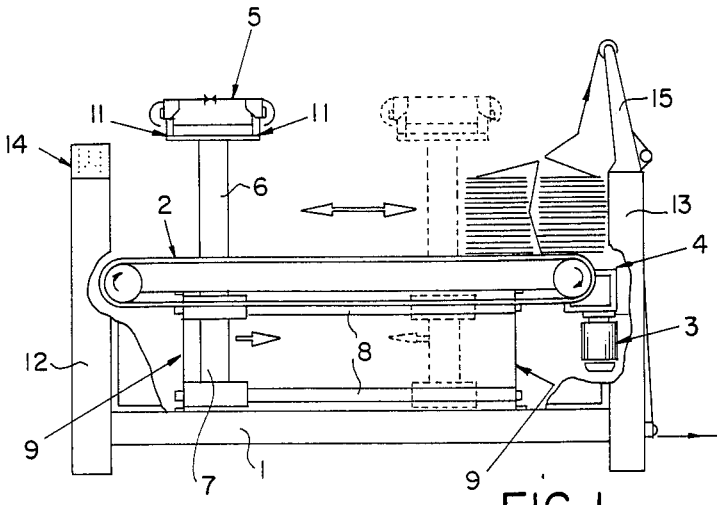
FIGS. 1–1A are a frontal and a side view of an extremely simplified service unit, showing the main movements, two joined packages arranged for being supplied to the printer and the conventional path of the paper towards the printer.
Figure 1A:
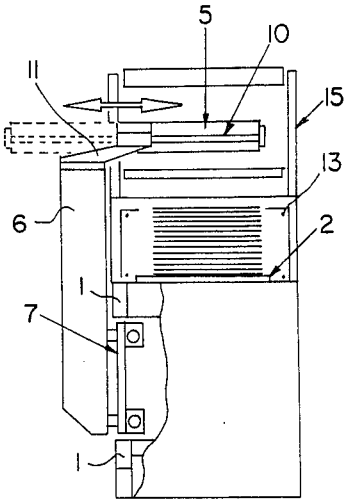

FIGS. 1, 1A show the construction of the service unit which, however, may also be different in the details. This unit comprises a main body 1 having a conveyor belt 2 mounted thereon and driven by a geared motor 3 which also acts as a backing plane for the paper packages to be joined. A sensor 4 senses the presence of the paper package in the right position for being supplied to the printer.

Joining plane 5 supported by column 6 which is secured to carriage 7 moving on guides 8 and anchored to body 1 through brackets 9, can move along the whole package backing plane of the unit. Joining plane 5 is also able to move in and out of the working area (full and dotted lines in FIG. 1A) through guiding rods 10 which are anchored to plane 5 and can slide within supports 11 rigidly secured to column 6.

Figure 2:
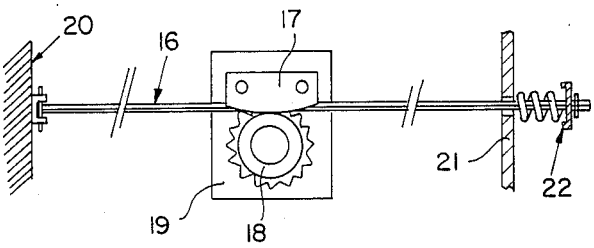
FIG. 2 shows a diagram of the powered movement of carriages 7 and 5 comprising standardized components.

Carriages 5 and 7 can be moved either manually by an operator or through a traditional device as shown in FIG. 2, comprising a chain 16 stretched between two stiff walls 20 and 21 through a tensioning assembly 22, and a support 19 to which a driving pinion 18 and a guiding shoe 17 are connected. Using this device, in the case of carriage 7 stiff walls 20 and 21 are formed by terminals 9, while support 19 is rigidly connected to moving plate 7 so that on the rotation of driving pinion 18 the carriage and, accordingly, column 6 supporting joining plane 5 are caused to move. Furthermore, applying this device to joining plane 5 considered as a carriage, supporting plane 19 is applied to stationary members 11 and walls 20 and 21 correspond to the ends of joining plane 5. In this case, on the rotation of driving pinion 18 carriage-joining plane 5 moves with respect to column 6, which movement is represented in FIG. 1A by the positions in full and dotted line of joining plane 5.

End members 12 and 13 of the service unit substantially have the function of defining backing plane 2, even if the control unit of the apparatus 14 and an assembly of arms and rollers have been placed on ends 12 and 13, respectively, in order to optimize the removal of the paper from the package arranged to be supplied to the printer.

Figure 3:
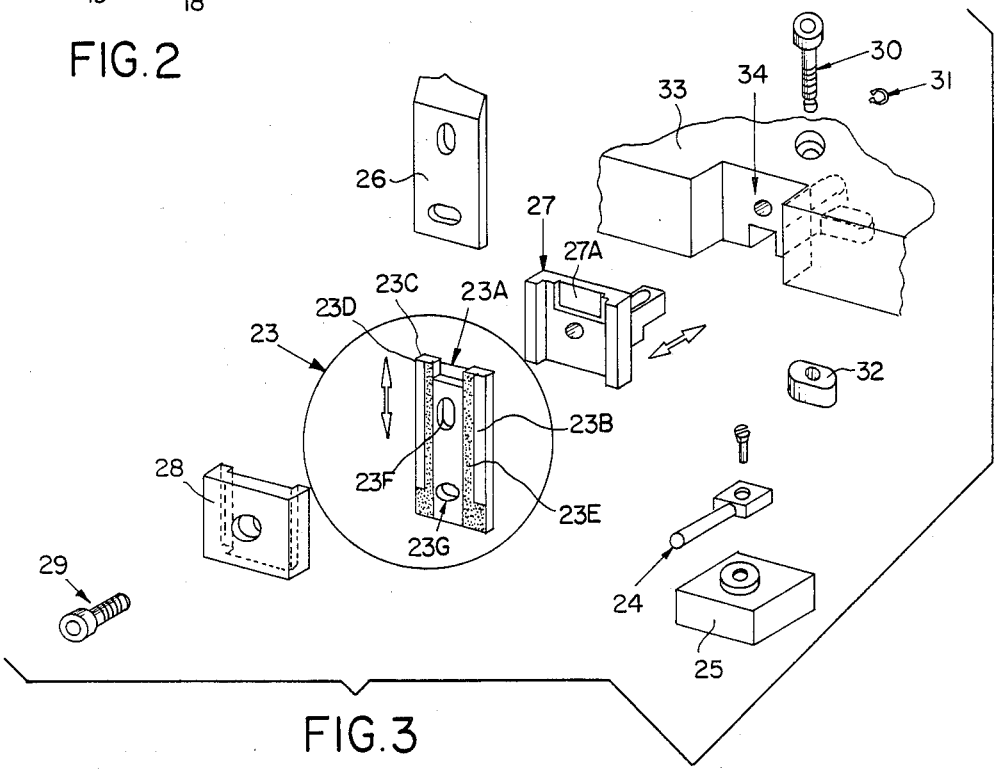
FIG. 3 is an exploded view of the cutting blade and the components of the holding guide and the transport means, forming a device which allows the adhesive tape to be cut without using a counterblade.

FIG. 3 is an exploded view of the adhesive tape cutting assembly which allows the cutting operation to be carried out without using counter blades. The main member for this operation is cutting blade 23 which comprises a heatable element such as a suitable electric resistance 23A which is heated by the Jaule effect on the cutting operation. The resistance is rigidly connected to blade body 23B by through holes 23C and weldings 23D between the resistance and electric paths 23E, thus forming a monolithic component which allows the cutting of the adhesive tape to be easily carried out as it is heated and approached to the adhesive tape through raising pin 24 operated by piston 25. The cutting is controlled by an operator, while the heating time and the to-and-fro movement time, which are extremely short and almost instantaneous, are controlled by a microprocessor.

FIG. 3 also shows a conventional cutting blade 26 which, to minimize the forces acting on the cutting to an acceptable value, has been cusp shaped with a central tip protruding for the cutting engagement. Also in this case, the adhesion force of the adhesive tape on counterguide 28 after the joining operation is sufficient to assure the tape cutting, provided the tape is of a suitable type. Again with reference to FIG. 3, the adhesive tape cutting assembly comprising blade 23 also comprises a holding guide for blade 23 including members 27 and 28 connected to each other by a screw 29. When these members are tightened a space 27A intended to receive resistance 23A is formed on member 27. The vertical movement of the blade is formed by opening 23F provided on the blade.

The body of guiding carriage 27 is secured to joining plane 33 by tightening plate 32 through screw 30. This device allows the distance between the holes for placing in position the paper to be joined and the outer edge of the sheet where the adhesive tape is cut to be adjusted by sliding all the cutting carriage with respect to support 33. It should be noted that these adjustments are extremely reduced since the distances are standardized and can vary only from one supply of paper support to the other.

The tightening screw of blade supporting carriage 30 is provided with a stop 31 preventing tightening plate 32 to go out from the seat therefor formed in support 33. Space 34 is provided only for the possible protruding portion of screw 29. Piston 25 is rigidly connected to paper support 33 and the cutting position is adjusted through opening 23 which remains constantly engaged with pin 24.

Cover 28, which is made from an electrically insulating material, is at the same top level of plane 33 when it is placed in the seat therefor. A further feature of this device is that blade 23 can be replaced by simply untightening screw 29 and removing cover 28, thus allowing the paper-blade adjustment to remain unchanged.

FIGS. 4–4C show in detail joining plane 5 of FIG. 1 and the characteristic components thereof. The body of this plane is formed by plate 40 which is supported and made slidable through guiding rods 10 rigidly connected thereto by means of a support 41. These rods and accordingly the plane slide in supports 11 which are rigidly connected to supporting column 6 through plate 42.

In the body of the joining plane a housing is formed intended to receive cross-shaped carriage 43 and capable of sliding thereon in order to adjust the width of the paper to be joined. This carriage is moved through screws 44 which are rigidly screwed in body 40 and can be operated by handles 45. Screws 44 engage the carriage through lead nuts 46.

In order to avoid remarkable discontinuities, the central surface of the joining plane has been provided with sliding filling sectors 47, the function of which is clearly shown in FIG. 4.

The retractile pins for positioning and blocking the paper on the joining plane are applied on the plane body on one side and on moving support 43 on the other side. The embodiment of the assembly, the components and the transport means are identical for both sides and, accordingly, FIG. 4A shows a sectional view of the moving side.

As shown, this assembly comprises four "combs", each comprising a plurality of pins 49 having a suitable diameter and shape allowing them to easily engage with a sufficient grip the transport holes of the paper support. These pins are connected to a base plate 50 through elastic sealing rings, thus obtaining a non rigid connection and avoiding the need of identical center distances for allowing the pins to slide in the guiding holes formed on plane body 40 and cross-shaped support 43. These paper support positioning and blocking pins are normally held in the retracted position by members 51 and, in this case, pneumatic piston 52 is a stop member. Pistons 52 are controlled in order to cause pins 49 to come out of the upper side of the joining plane. Thus, these pins are used to place and maintain in position the paper support to be joined. The number of the pins is higher at the center and outer sides of the plane, thus allowing the paper to exert a better grip thereon. Similar solutions aiming at the same results have not been described since they are equivalent.

Adhesive tape roll 55 is connected to the joining plane by a bracket 54 and the tape support 56 is held in place by a snap removable cover 58. FIG. 4C shows the 90° tape transmission which drives adhesive tape 58 from roll 55 to guiding wheels 59 and 60 through stationary pin 57. The mounting of the tape on support 56 is such that the tape side sliding on pin 57 is the non adhesive side, while the adhesive side of the tape rests on cylinders 59 and 60. Cylinders 59 and 60 are supported by members 62 and 61, respectively. Supports 61 have the shape of a chute facing the inner portion of the plane and, accordingly, they also facilitate the coming out of the plane after the joining operation and the engagement of the adhesive tape with cylinder 60. This engagement occurs after the tape has been stretched in the correct position, referred to by reference 58 in FIG. 4B, before the joining operation. The necessary functions of holding the tape in the stretched condition referred to by reference 58 in FIG. 4B and exerting a resistance to the adhesion of the tape have been described above.

As regards the adhesive tape cutting blades and the operation thereof described above with reference to FIG. 3, the mounting of these blades should only be described. As in the case of the above-mentioned device, FIG. 4B shows the moving side only, since the other side is identical. FIG. 4B clearly shows cutting blade 23, main support 27, operating pin 24 driven by piston 25 which is supported by a bracket 48. FIG. 4B also shows a blocking screw 30 which is intended to adjust the distance between the positioning pins and the edge of the cutting blades shown also in FIG. 4.

FIG. 4A shows only the two side members of the joining plane fairing referred to by reference 53, which members have a protective and aesthetic function, but also the function of engaging the package paper to be joined with the joning plane.

FIGS. 5A–5E show the steps of the joining of two adjacent packages. These steps comprise:

(1) placing the packages on the unit plane with the last sheets of each package outcoming from below. Preformed packages are available on the market;

(2) placing the forms to be joined on the joining plane;

(3) stretching the adhesive tape;

(4) sticking the tape on the sheets;

(5) cutting the adhesive tape and moving the paper positioning pins to the retracted position; and, (6) causing the joining plane to come out from below the joined forms.

With reference to FIG. 5A the paper packages to be joined are referred to by references 64 and 67 and they are placed on package backing plane 2. Reference 64 refers to the forward package and sheet or form 65 is the last sheet of this package. On this operation joining plane 5 is conveniently placed between the two packages to facilitate the operation, the positioning and blocking pins being "out", as indicated by reference 49. Sheet 65 is placed in position on the joining plane by fitting these pins in the paper transport holes and causing the end edge of the sheet to coincide with the central line of the plane referred to by reference 70.

FIG. 5A also shows the steps intended to facilitate the joining operation and accordingly, placing sheet 65 with the end edge thereof at the center of the plane and causing the pins to fit inwardly with respect to the plane, either lowering the sheet or letting it down as shown by arrow 71. On this operation the fitting of the positioning and blocking pins should be manually helped. The same operation should be carried out with the first sheet or form 68 of package 67 in a specular way with respect to the central line of plane 5, as shown by arrow 72.

On the above-described operation of placing the paper to be joined on the joining plane, the folding of the sheets should be maintained so that folds 66 and 69 will be in the same direction at the end of the operation. In case the folds are contrary to each other it is sufficient to remove the sheet on one side before joining. This is necessary because the paper web formed by the folded and continuously joined sheets should behave as a component of a single big package in order to avoid any problems downstream of the printer.

It should be noted that the tape joining sheets 65 and 68 is of a special type having a central punching, available on the market from specialized manufacturers. Thus, this tape is not an obstacle either to the folding of the joined sheets or to the tear separation thereof following the processing operation.

With reference to FIG. 5B, after the sheets have been placed on the joining plane adhesive tape 58 is stretched from guiding cylinder 59 to the position shown in dotted lines and referred to by reference 73.

The tape is then lowered onto guiding cylinder 60, thus reaching position 74 shown in full line and being centered with respect to the central line of the plane and exactly between two adjacent sheets 65 and 68. This operation is facilitated by the engagement of supports 61 and the shape of receiving cylinder 60. As mentioned above, the tape remains suitably tensioned between guiding cylinders 59 and 60, the adhesive side thereof facing towards the plane.

The following step of sticking the adhesive tape on sheets 65 and 68 in order to join them is shown in FIG. 5C by arrows 75 and 76. The adhesive tape is pressed by a finger on the two sheets in the central position of the joining plane. Then, this pressing is carried out from one side to the other of the plane, thus causing the tape to adhere on the two covers of the cutting blades, referred to by reference 28 in FIG. 3. These covers are placed outwardly with respect to the sheets and flush with the joining plane between reference and blocking pins 49 and cylinders 59 and 60.

The following step of cutting the adhesive tape is shown in FIG. 5D by arrows 77, the coming out of blades 23 being controlled by an operator. When the adhesive tape has been cut and the cutting blades have returned to their seats, also the paper positioning pins 49 are programmed to retract below the plane level.

The adhesive tape length 78 remaining on cylinder 60 is removed by the operator, thus avoiding any obstacles to the successive step in which joining plane 5 comes out of the working area above the packages to be joined. This coming out of the joining plane is shown in FIG. 5E by arrow 79 and can be either programmed or manually carried out, according to the type of the service unit.

The above described operation, that is the joining of two adjacent packages requires a practical time not exceeding 30 seconds, comprising the possible refolding of sheets 68 and 65 on package 67, to obvious order purposes.

Finally, FIGS. 6A–6C show a conventional cycle of complete refilling of the unit during the normal use thereof.

FIG. 6A shows the step of calling of the unit to the operator, which calling can be carried out either with a sound or a light signal. As mentioned above, this step lasts all the time required to process the last package being supplied to the printer, unless the operator intervenes.

FIG. 6B shows an intermediate filling step, when the operator has already placed in position all the sheet packages and continuously connected the first three packages.

Finally, FIG. 6C shows the unit at the end of the operation; as shown, it has been considered that the printer has continued to be supplied. At the end of this operation the operator has to store the total number of the packages present on the plane in the microprocessor memory.

Finally it should be noted that this invention allows an extremely compact version of the unit to be carried out, having such a size as to receive two packages only. This feature is quite important, considering that the space available does not always correspond to the space required.

I claim:

1. A service unit for continuously supplying a high-speed printer with a preformed paper support in folded packages, which unit has a long working autonomy without requiring the intervention of an operator, said unit comprising in combination: a support frame, a package backing plane comprising a conveyor belt controlled by a microprocessor having a sensor for placing in position each packaging to be supplied to said printer; and, a plane for joining the paper support packages, said joining plane being able to move along a plane parallel to said package backing plane and placed above said package backing plane at such a height that said packages cannot be touched thereby, thus allowing the ends of the packages placed side by side to continuously connected to each other by an adhesive tape, wherein said joining plane comprises a plurality of completely retractile reference and blocking pins intended to place and maintain in position said ends to be joined; a filling assembly for the central joining area; and, an assembly for automatically cutting said adhesive tape, and wherein said joining plane also comprises: an assembly for supporting the adhesive tape roll; a transmission means; a guiding and a reference means; a friction assembly acting directly on said adhesive tape and not on said roll in order to stretch, place in position and stick said tape on said paper support to be joined; a driving means and pneumatic assemblies for operating said members and/or support, transport and moving assemblies; and, an electronic unit for controlling the synchronized and selective operation of said means, members and assemblies.

2. The service unit according to claim 1, wherein said assembly for automatically cutting said adhesive tape comprises a thin heated member, such as a wire-wound resistance which is the cutting member of said assembly, said wire being supported by a blade body made from an electrically insulating and heat-resisting material, comprising guides for the movement of said cutting member on the heating of said wire.

3. The service unit according to claim 1, wherein said assembly for automatically cutting said adhesive tape comprises a blade having a cusp shaped cutting portion in a central position with respect to said adhesive tape, the protruding point of said cutting portion starting to cut said tape adjacent to the axis thereof.

4. The service unit according to claims 1 or 3, wherein said cutting member is received in a blade guide secured to the body of the member which supports said pins for placing and blocking in position said ends of said paper support to be joined and is provided with a device for adjusting the relative distance between said pins and said cutting blade.

5. The service unit according to claim 1, wherein said plane for joining said ends of said paper support is provided with an assembly of completely retractile pins for placing in position said paper support to be joined, said assembly comprising a plurality of pins having suitable size and shape, sliding in respective guiding holes and being operated by a cylinder and piston assembly acting on a portion of said pins through a plate on which said pins can be keyed either fixedly or movingly.

6. The service unit according to claim 1, wherein said plane for joining said ends of said paper support is provided in its central area for sticking said adhesive tape with an assembly for leveling the inevitable depressions formed by substantial variations in the transversal size of said paper support to be joined, which does not require any outer member to the plane and comprises a certain number of small sliders which can be engaged and disengaged at will.

7. The service unit according to claim 1, wherein said adhesive tape for joining said ends of said paper support is frictionally held at the right tension by causing the adhesive side of said tape to slide, on the stretching thereof, on a rotating cylinder made from a suitable material and having a suitable diameter.

8. The service unit according to claim 7, wherein said adhesive tape for the joining operation is stretched on two rotating cylinders with the adhesive side thereof facing said cylinders which are placed outwardly of said paper support to be joined thus allowing said tape to be completely stretched on said paper support and then raised, so that during the following step of sticking, said adhesive tape can be sufficiently released both on the roll side and on the opposite side, in order to compensate the variation of the tape path during the sticking thereof without increasing the base tension.

* * * * *